United States Patent [19]

Hoyt et al.

[11] Patent Number: 4,669,282

[45] Date of Patent: Jun. 2, 1987

[54] STUD MOUNTED DOOR LOCK

[76] Inventors: Carmi I. Hoyt, 3180 Roanoke St., Flint, Mich. 48084; Stanley J. Piotraczk, 3058 Vineyard La., Flushing, Mich. 48433

[21] Appl. No.: 856,427

[22] Filed: Apr. 21, 1986

Related U.S. Application Data

[63] Continuation of Ser. No. 677,890, Dec. 4, 1984, abandoned, which is a continuation of Ser. No. 262,116, May 11, 1981, abandoned.

[51] Int. Cl.[4] ..... E05B 65/06

[52] U.S. Cl. ..... 70/129; 70/380; 70/465; 292/140; 292/150; 292/DIG. 27; 292/DIG. 65

[58] Field of Search ..... 70/134, 129, 465, 416–418, 70/379 R, 380; 292/150, DIG. 27, DIG. 65, 337, 169, 140, 336.5

[56] References Cited

U.S. PATENT DOCUMENTS

| | | | |
|---|---|---|---|
| 912,587 | 2/1909 | Marion | 292/DIG. 27 |
| 1,811,291 | 6/1931 | Banker | 292/337 X |
| 1,845,963 | 2/1932 | Ellingson | 70/380 X |
| 2,095,607 | 10/1937 | Lejbowicz | 70/129 |
| 2,380,708 | 7/1945 | Schlage et al. | 292/140 |
| 2,522,878 | 9/1950 | Larson | 292/150 X |
| 2,630,004 | 3/1953 | Welshons | 70/134 |
| 2,926,946 | 3/1960 | Stackhouse | 292/333 |
| 3,225,575 | 12/1965 | Lucas | 70/134 |
| 3,751,953 | 8/1973 | Newman | 70/418 X |
| 3,829,139 | 8/1974 | Storlie | 70/465 X |
| 3,890,813 | 6/1975 | Cothron | 70/92 |
| 3,971,238 | 7/1976 | Walker | 70/135 |
| 4,099,754 | 7/1978 | Hoebing | 292/DIG. 65 |
| 4,127,016 | 11/1978 | Ibsen | 70/92 |
| 4,300,793 | 11/1981 | Benzel | 292/205 |
| 4,341,408 | 7/1982 | Blevins | 292/150 |
| 4,475,364 | 10/1984 | Frank | 70/451 X |

FOREIGN PATENT DOCUMENTS

| | | | |
|---|---|---|---|
| 283850 | 4/1915 | Fed. Rep. of Germany | 70/379 R |
| 313586 | 7/1919 | Fed. Rep. of Germany | 70/129 |
| 472651 | 3/1929 | Fed. Rep. of Germany | 292/150 |
| 2627029 | 12/1977 | Fed. Rep. of Germany | 70/129 |
| 215094 | 9/1967 | Sweden | 70/129 |
| 298347 | 10/1928 | United Kingdom | 292/358 |
| 805697 | 12/1958 | United Kingdom | 70/379 R |

*Primary Examiner*—Robert L. Wolfe
*Assistant Examiner*—Lloyd A. Gall
*Attorney, Agent, or Firm*—Gifford, Groh, VanOphem, Sheridan, Sprinkle and Dolgorukov

[57] ABSTRACT

A door lock is provided for use with a building wall having a door opening formed by building framing members and in which a door is pivotally mounted and movable between a closed and an open position. The door lock has a locking bolt which is slidably mounted by a slide block to the building framing members on the inside of the wall. A key operated assembly accessible from the outside of the wall is operable to move the locking bolt between a locking position in which a portion of the bolt extends behind the door and thus into the path of the door swing, and a nonlocking position in which the bolt is retracted into the slide block and thus spaced downwardly from the path of the door swing. Since the slide block is mounted to the building framing member, typically a two by four wooden stud, the door lock utilizes the strength of the building itself rather than just the strength of the door or its jamb.

8 Claims, 5 Drawing Figures

STUD MOUNTED DOOR LOCK

This is a continuation of application Ser. No. 677,890 filed on Dec. 4, 1984, which is a continuation of Ser. No. 262,116 filed on May 11, 1981, both of which are abandoned.

BACKGROUND OF THE INVENTION

I. Field of the Invention

The present invention relates generally to locks and, more particularly, to a dead bolt type door lock.

II. Description of the Prior Art

There are a number of previously known door locks and, many of these door locks are of the so-called dead bolt type. In a dead bolt lock, the lock mechanism is secured to the inside of the door on the side of the door opposite from its hinged side. A dead bolt is slidably mounted within the lock mechanism and, in its locking position, engages a keeper which is mounted on the door jamb.

These previously known dead bolt locks, however, have not proven wholly satisfactory in use. One disadvantage of these previously known dead bolt locks is that the security provided by the lock is limited to the structural integrity of the door jamb. Door jambs, however, are usually contructed of a relatively soft wood which can be easily broken by an intruder. As such, these previously known dead bolt locks have not provided adequate security against forced entry of the door.

SUMMARY OF THE PRESENT INVENTION

The present invention provides a high security door lock which utilizes the inherent strength of the building itself, rather than just the door jamb, to prevent forced entry of the door.

In brief, the door lock according to the present invention comprises a slide block which is mounted directly to the building framing members on the inside of a building wall and is also connected by a bolt and nut which extend from the exterior side of the wall. The slide block includes a channel in which a preferably rectangular locking bolt is slidably positioned and movable between a locking position and a nonlocking position. In its nonlocking position, the bolt is nested within the slide block assembly so that the door can be freely moved between an open and closed position. Conversely, in its locking position, the dead bolt protrudes outwardly from the slide block and behind the door and thus prevents the door from being opened with in a closed position.

A key operated lock is accessible from the outside of the door and includes an elongated key shaft which extends through a bore formed through one of the wall framing members, typically a two by four wooded stud. The free end of the key shaft extend through a hole in the slide block and a slot in the locking bolt and is accessible on the inside of the wall. The free end of the elongated member is coupled to the locking bolt by an actuating member so that rotation of the key shaft by the proper key moves the locking bolt between a locking and nonlocking position in dependence upon the direction of rotation of the key shaft.

In a preferred form of the invention, the actuating member includes a manually retractable pin which, upon retraction, uncouples the actuating member from the locking bolt and enables the locking bolt to be manually moved between its locking and nonlocking position from the inside of the door. This manual release mechanism thus enables the locking bolt to be manually moved to its nonlocking position from the inside of the door in the event of an emergency, such as a fire. However, upon the release of the spring loaded plunger and rotation of the key the mechanism will revert to its original operative position using the key.

The door lock according to the present invention is advantageous in that the slide block in which the locking bolt is slidably received is directly attached to the framing members of the building. Consequently, the lock of the present invention utilizes the inherent strength of the building itself rather than simply the strength of the door jamb as in the previously known device and effectively prevents forced entry of the door.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
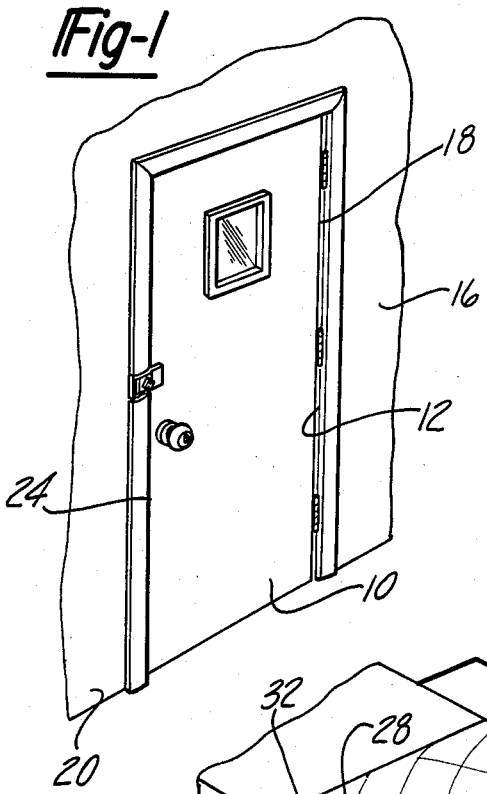
FIG. 1 is a perspective view illustrating a preferred embodiment of the door lock according to the present invention installed adjacent a door.
Figure 2:
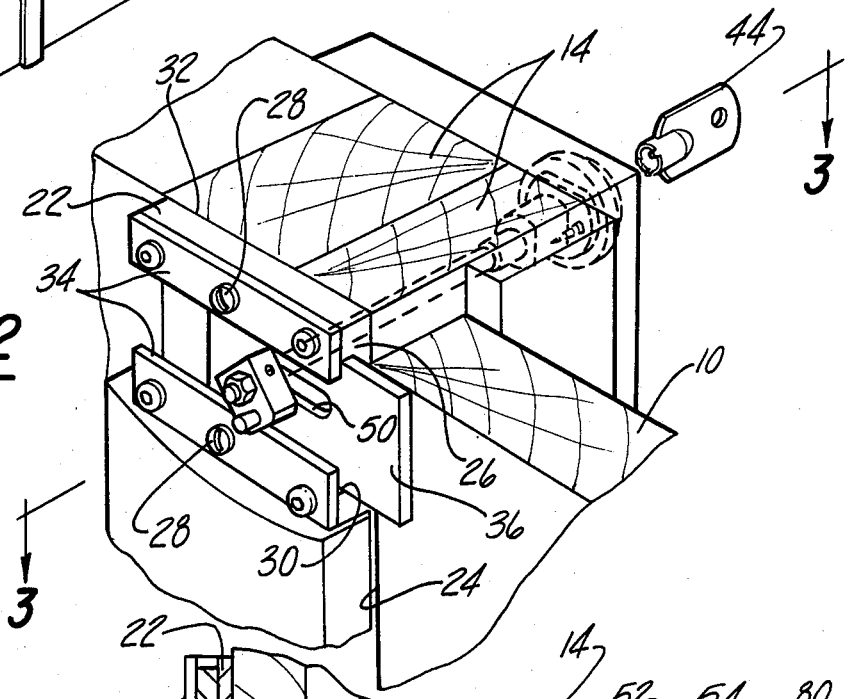
FIG. 2 is a fragmentary partial sectional view illustrating a preferred embodiment of the invention.
Figure 3:
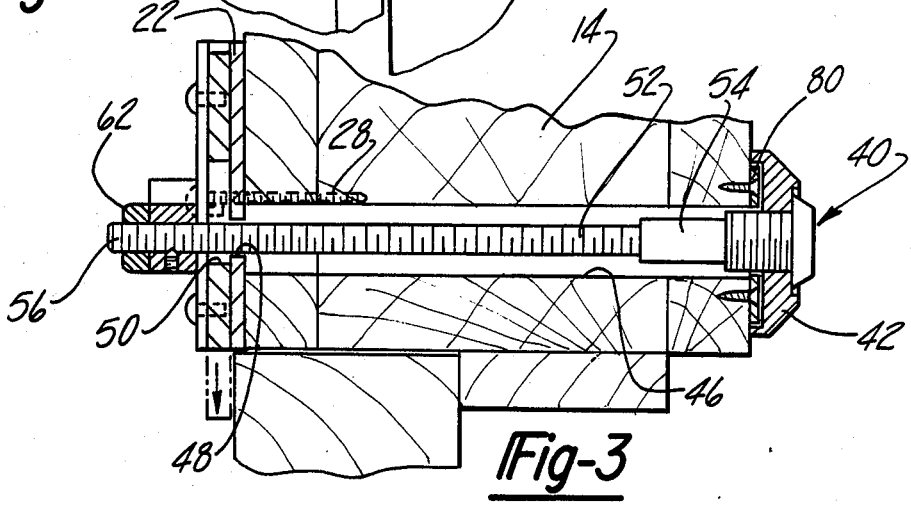
FIG. 3 is a fragementary sectional view taken substantially along line 3—3 in FIG. 2 and enlarged for clarity.

With reference first to FIGS. 1-3, a preferred form of the door lock according to the present invention is thereshown in conjunction with a door 10 of the type which is commonly found in residential dwellings. The door 10 is mounted within a door opening 12 formed by framing members 14 of a building wall 16. These framing members 14 are typically constructed from two by four wooden studs. Moreover, with conventionally accepted building practices, two framing members or studs 14 are secured together side-by-side on each side of the door opening 12.

The door 10 illustrated in the drawing is conventional in construction and is hinged along one side 18 within the door opening 12 and movable between a closed position and an open position. In the closed position, as shown in FIG. 1, the door 10 covers or closes the door opening 12 while in its open position, the door 10 extends into the inside 20 of the building wall 16.

Still referring to FIGS. 1-3, the door lock of the present invention comprises a slide block 22 which is positioned on the inside 20 of the wall 16 and closely adjacent the side 24 of the door 10 opposite from its hinged side 18. The slide block 22 is generally rectangular in shape and has one edge 26 which is positioned parallel to and closely adjacent the door side 24. The sllide block 22 is directly secured to the wall framing members 14 by long screws 28.

The slide block 22 further includes a generally C-shaped channel 30 which is open to the side 26 of the slide block 22. Furthermore, although the slide block 22 is illustrated in the drawing as comprising a base plate 32 and two flange members 34 which together form the channel 30, the slide block 22 can alternatively be of integral construction.

Figure 4:
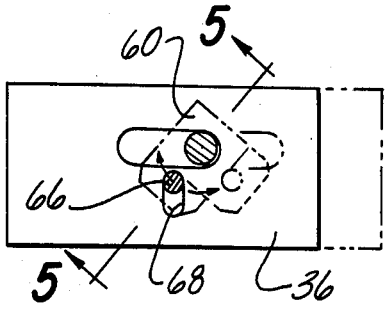
FIG. 4 is a partial sectional view illustrating a portion of the preferred embodiment of the door lock according to the present invention.

With reference now to FIGS. 2–4, a generally rectangular and flat locking bolt 36 is slidably mounted within the C-shaped channel 30 and movable between a locking position, illustrated in phantom line in FIG. 3, and a nonlocking position, illustrated in solid line in FIG. 3. In its locking position, the bolt 36 extends outwardly from the channel 30 so that a portion of the bolt 36 is positioned behind the door 10 and thus within the path of the swing of the door 10. Conversely, in its nonlocking position, the locking bolt 36 is nested within the C-shaped channel 30 on the slide block 22 and thus is spaced outwardly from the path of swing of the door 10 so that the door 10 can be freely moved between an open and a closed position. With the locking bolt 36 in its locking position, however, a substantial portion of the locking bolt 36 remains within the C-shaped channel 30 and thus remains effectively attached to the wall framing members 14.

As will be subsequently described in greater detail, the slide block 22 is rigidly secured against outward movement by a bolt and nut which extend from the exterior of the wall 16.

With reference now particularly to FIGS. 2–4, a key operated lock 40 is provided for moving the bolt 36 between its locking and nonlocking positions. The key lock 40 includes a retaining plate 80 which prevents the lock 40 from rotating while a cover plate 42 covers the plate 80 around the lock 40. The cover plate 42 is freely rotatable and serves both to prevent the lock 40 from being forcibly turned by a tool and also anchors the slide block 22 to the wall as will become shortly apparent. A key 44 is provided to actuate the bolt for authorized entry through the door 10.

The key receptacle 42 registers with a throughbore formed through one of the framing members 14 which in turn registers with both a hole 48 formed in the slide block 22 and a longitudinal slot 50 formed in the locking bolt 36.

An elongated key shaft 52 is positioned through the framing member bore 46 so that one end 54 of the key shaft 52 is rigidly attached to the key lock 40 while the opposite end 56 is accessible at the inside of the building wall 16. The key shaft 52, moreover, is attached to the key lock 40 in the conventional fashion so that insertion and rotation of the proper key 44 in the key lock 40 rotates the key shaft 52. In addition, the key shaft is threaded substantially along its entire length so that it can accommodate walls of different widths.

Figure 5:
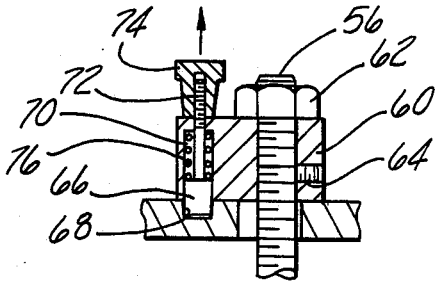
FIG. 5 is a sectional view taken substantially along line 5—5 in FIG. 4 and enlarged for clarity.

With reference now to FIGS. 3–5, an actuating member 60 is attached to the free end 56 of the key shaft 52 by a nut 62 while a set screw 64 threaded in the actuating member 60 intersects the key shaft 52 and ensures that the actuating member 60 will rotate in unison the key shaft 52. A pin 66 mounted in a cavity 70 in the actuating member 60 at a point radially spaced from the key shaft 52 engages a transversely extending groove 68 on the locking bolt 36. Consequently, as best shown in FIG. 4, rotation of the key shaft 52 with its attached actuating member 60 causes the locking bolt 36 to move between a locking position, shown in phantom line in FIG. 4, and a nonlocking position, shown in solid line in FIG. 4 due to the coaction of the pin 66 with the transverse groove 68.

The key shaft 52 together with the key lock cover plate 42 and actuating member 60 functions to anchor or secure the slide block 22 and locking bolt 36 against outward movement from the wall 10. Thus, upon an attempted forced entry through the door 10, it would be necessary to pull the key shaft 52 with its attached key lock 40 and cover plate 42 through the framing members 14.

It is highly desirable to enable the locking bolt 36 to be manually moved from its locking end to its nonlocking position, or vice versa, from the inside of the door. Otherwise, the door lock 36, when in its locked position, would form a safety hazard in the event that an emergency exit from the building is required. Consequently, and with reference to FIG. 5 of the drawing, in a preferred form of the invention the pin 66 is slidably mounted within the cavity 70 in the actuating member 60. A reduced diameter portion of the pin 72 extends both through a portion of the cavity 70 and through a hole in the actuating member 60 while a knob 74 is attached to the free end of the pin reduced diameter portion 72. A compression spring 76 within the cavity 70 and positioned around the pin portion 72 urges the pin 66 toward the transverse groove 68 on the locking bolt 36. However, the pin 66 can be manually disengaged from the groove 68 by manually grasping the knob 74 and pulling the pin 66 out of the groove 68. Thereafter, the locking bolt 36 can be manually slid to either its locking or nonlocking position.

Although the operation of the door lock according to the present invention should by now be clear, it will be briefly summarized. Assuming the door 10 is in its closed position and that the locking bolt 36 is initially in its inlocked position, the locking bolt 36 can be moved to its locking position by insertion and rotation of the key 44 into the receptacle 40. Upon rotation of the key 44, both the key shaft 52 and actuating member 60 pivot in unison with the key 44 which moves the bolt 36 to the postion shown in FIG. 2. Conversely, rotation of the key in the opposite direction moves the locking bolt 36 from its locking and to its nonlocking position.

Assuming that the door lock is in its locked position, upon the attempted forced entry through the door 10, the locking bolt 36 abuts against the back or inside of the door 10 and prevents the door from being opened. Furthermore, since the slide block 22 is secured directly to the wall framing members 14 by the key shaft with its attached key lock 40 and cover plate 42 as well as the screws 28, it is necessary for an intruder to overcome the strength of the wall framing members 14, rather than just the door jamb, in order to successfully force open the door 10. Since the wall framing members 14 are of high strength, such a forced entry is virtually impossible.

From the foregoing, it can be seen that the door lock according to the present invention is advantageous in several different respects. Perhaps most importantly, the door lock according to the present invention utilizes the inherent strength of the building itself, rather than just the strength of the door jamb, so that forced entry of the door is virtually impossible. The present invention is further advantageous in that the locking bolt 36 can be easily manually moved between its locking and nonlocking position from the inside of the building. Consequently, the lock of the present invention provides security for the building regardless of whether the premises are occupied or vacant.

A still further advantage of the present invention is that, due to the positive engagement between the actuating member pin 66 and the locking bolt 36, the lock cannot be opened from the outside by using a thin metal or plastic member. Furthermore, since the lock is purely mechanical in structure, it remains functional without the use of a power source, such as batteries, or line current from the building.

In addition, the present invention is advantageous in that it is readily adaptable to any type of entry or exist door provided, of course, that the door swings toward the interior of the building in the conventional fashion. The installation of the door lock can also be achieved without modification, whatsoever, to the door itself.

Having described my invention, however, many modifications thereto will become apparent to those skilled in the art to which it pertains without deviation from the spirit of the invention as defined by the scope of the appended claims.

We claim:

1. In combination with a building wall having a door opening formed by studs, a door pivotally mounted in said door opening and movable between a closed position in which said door closes said door opening and an open position in which said door extends outwardly from one side of the wall, a door lock comprising:

a locking bolt having an elongated slot extending along a first axis of said bolt, said slot having a predetermined width;

means secured to said studs for slidably mounting said locking bolt on said one side of the wall, said bolt being movable between a locking position in which a portion of said bolt being extends into the path of swing of said door and a nonlocking position in which said bolt is spaced outwardly from the path of the door swing, and means for selectively moving said bolt between said locking and nonlocking positions, wherein said selective moving means comprises a key receptacle attached to said other side of the wall, an elongated key shaft attached at one end to the key receptacle, said key shaft extending through a bore in one of said studs and through said elongated slot and having its other end accessible at said one side of said wall, and actuating means attached to said other end of said key shaft for moving said bolt between said locking and said nonlocking position in dependence upon the rotation of said key shaft, wherein said actuating means comprises an actuating member secured to said key shaft so that said actuating member and key shaft rotate in unison with each other, said actuating member having a width greater than said predetermined width of said slot to anchor said key shaft in said bore, a pin attached to said actuating member at a position radially spaced from said key shaft, said pin being having one end which is positioned within a groove in said bolt, said bolt groove extending in a direction transverse to the direction of movement of said bolt, and including manually operated means for retracting said, end from said groove.

2. In combination with a building wall having a door opening formed by a plurality of studs, a door pivotally mounted in said door opening and movable along a path between a closed position in which said door closes said door opening and an open position in which said door extends outwardly from one side of the wall, a door lock comprising:

a bolt having an elongated slot disposed along a first axis of said bolt and a groove disposed on a second axis normal to said first axis, said slot having a predetermined width, said bolt further having an end portion, means for slidably mounting said bolt on one side of said wall, said bolt slidable between a locking position where said end portion of said bolt extends into said path of movement of said door and a nonlocking position where said end portion is spaced outwardly from said path of movement of said door; and means for selectively moving said bolt between said locking and unlocking positions, said means for selectively moving comprising, a key receptacle mounted to another side of said wall, an elongated key shaft extending through a bore formed in one of said plurality of studs forming said door opening, said key shaft having one end portion attached to said key receptacle for movement therewith and an opposite end portion extending through said slot of said bolt, an actuating member rigidly affixed to said other end portion of said key shaft, said actuating member having a transversse width greater than said width of said slot for anchoring said key shaft in said bore, a pin slidably mounted to said actuating member, said pin having one end and an opposite end, extending outwardly from said actuating member, said pin slidable along an axis normal to the direction of movement of said bolt between an extended position in which said one end extends into said groove of said bolt for moving said bolt between said locking position and said nonlocking position when said key shaft and said actuating member are rotated and a retracted position in which said pin is retracted from engagement from said groove such that said bolt may be manually slid between said locking position and said nonlocking position.

3. The lock invention of claim 2 further comprising means for biasing said one end of said pin into said groove of said bolt, said means for biasing mounted to said actuating member.

4. The invention as defined in claim 3 wherein said bolt is substantially rectangular in shape and wherein said mounting means comprises a slide block having a channel in which said bolt is slidably received.

5. The lock invention as defined in claim 3 wherein a slide block includes one edge positioned adjacent to but spaced outwardly from the path of swing of said door, and wherein in said nonlocking position, said bolt is wholly nested within a slide block channel.

6. The lock invention as defined in claim 3 and including manually operated means for retracting said one end from said groove.

7. The lock invention as defined in claim 3 wherein said shaft is threaded substantially along its entire length.

8. The lock of claim 3 wherein a manually operating means comprises a knob affixed to said opposite end of said pin.

* * * * *